US009005110B2

(12) United States Patent
Lee

(10) Patent No.: US 9,005,110 B2
(45) Date of Patent: Apr. 14, 2015

(54) FROSTED GLASS TOY

(76) Inventor: Budiman Lee, Chatsworth, CA (US)

( * ) Notice: Subject to any disclaimer, the term of this patent is extended or adjusted under 35 U.S.C. 154(b) by 515 days.

(21) Appl. No.: 13/288,830

(22) Filed: Nov. 3, 2011

(65) Prior Publication Data

US 2013/0116501 A1 May 9, 2013

(51) Int. Cl.
*A61H 19/00* (2006.01)
*A61H 23/02* (2006.01)

(52) U.S. Cl.
CPC ..... *A61H 19/44* (2013.01); *A61H 23/02* (2013.01); *A61H 2201/0153* (2013.01); *A61H 2201/0111* (2013.01); *A61H 2201/1692* (2013.01)

(58) Field of Classification Search
CPC ... A61H 19/44; A61H 19/195; A61H 19/194; A61H 19/19; A61H 19/1932; A61F 5/00
USPC ..... 600/38–40; 601/46
See application file for complete search history.

(56) References Cited

U.S. PATENT DOCUMENTS

| | | | | |
|---|---|---|---|---|
| 2005/0004429 | A1* | 1/2005 | Tracanna | 600/38 |
| 2005/0033112 | A1* | 2/2005 | Bruton et al. | 600/38 |
| 2009/0234182 | A1* | 9/2009 | Buchholz | 600/38 |

* cited by examiner

*Primary Examiner* — Christine Matthews
(74) *Attorney, Agent, or Firm* — Laura M. Lloyd; Leech Tishman Fuscaldo & Lampl

(57) ABSTRACT

A decorative glass dildo comprising a solid, high density heat-resistant glass outer portion, a coated decorative inner portion, a sealing ring attached to the inner portion, an electrical conductive strip attached to the inner portion, and an end portion mechanically attached to the inner portion of the glass dildo.

20 Claims, 3 Drawing Sheets

FROSTED GLASS TOY

FIELD OF THE INVENTION

The present invention relates to sexual stimulation devices, and more particularly to a dildo with a decorative glass sheath.

BACKGROUND

Sexual stimulation devices of the prior art include dildos that have vibratory elements such as disclosed in U.S. Application Publication Nos. 2009/0234182 to Buchholz, 2008/0306417 to Imboden et al., 2007/0106109 to Ly and 2005/0033112 to Bruton et al. It is also known to provide accurate deformation of a prosthetic device such as a dildo as disclosed in U.S. Application Publication No. 2006/0069329. Another class of dildos avoids vibratory and other powered forms of stimulation, relying primarily on the shape of a rigid or semi-rigid device, such as disclosed in U.S. Pat. No. 2005/0004429 to Tracanna, U.S. Pat. No. 6,533,718 to Ritchie et al., U.S. Pat. No. 5,853,362 to Jacobs and U.S. Application Publication No. 2005/0033112 to Bruton et al. Materials disclosed as suitable for these devices include wood, metal, plastic, rubber, wax, glass, stone and composite material. However it is believed that none of this class of devices of the prior art has proven entirely satisfactory, for a variety of reasons. For example, currently known colored outer coatings for Pyrex glass are believed to be toxic, requiring an additional outer layer of glass to be added, thereby significantly increasing the cost to manufacture. Also, the use of metal plating as described in United States Patent Application No. 2011/0021870 to Lee, have the disadvantage of potentially exfoliating from the underlying surface after repeated use and washing diminishing the visual appeal of the device and potentially introducing toxins to the user. Additionally, making any intricate patterns using metal coatings requires repeated application of metals that may not adhere to one another, and require potentially toxic glue or varnish that, disadvantageously, can be absorbed from the device into the user.

Therefore, there is a need for a sexual stimulation device in the form of a dildo that provides improved appearance and decorative features as compared with existing devices.

SUMMARY OF THE INVENTION

The describe invention meets this need by providing a decorative glass dildo comprising a solid, high density heat-resistant glass outer portion; a coated inner portion; a waterproof ring gasket attached to the inner portion; an electrical installation ring attached to the inner portion; and an end portion mechanically attached to the interior portion of the glass dildo. The coated inner portion can comprise decorations, appealing colors and/or motifs. The glass outer portion can be made from a variety of colored glass such as frosted glass, milky glass, opalescent glass and cracked glass.

Optionally, the exterior can have a plurality of stimulation protuberances. These protuberances can be a spaced array of rounded knobs to provide added stimulation or bumps, knobs, ridges, indents and/or serpentine ridges. The glass outer portion is substantially in the form of an erect penis, and the frosted coating is placed on the interior portion. Optionally the device comprises one or more vibrating elements and a switch for actuating the one or more vibrating elements.

In one embodiment, the end portion is elongated to act as a handle or curved. In another embodiment, the end portion is a union between one or more decorative glass dildos.

The decorative glass dildo can also comprise a generally cylindrical interior housing to contain all mechanical and electrical parts of the decorative glass dildo; a vibrating element attached to the interior housing; a battery housing slidably attached to the interior housing; a cathode springably attached to the battery housing and the switch; and an electrical conductive strip to provide a circuit path between batteries contained in the battery housing, the cathode and the switch. In one embodiment, the interior housing is affixed to the inner portion of the decorative glass dildo by non-toxic adhesive means, such as, for example, silicon glue, contact cement and general purpose glue. The end portion further comprises screw like ridges for attaching to the battery housing. The switch comprises an actuator; a printed circuit board electrically attached to the actuator; and a cathode tensioning spring electrically attached to the printed circuit board. Optionally, the switch mechanism can comprise multiple settings to vary the speed, intensity, bore and stroke of the decorative glass dildo.

BRIEF DESCRIPTION OF THE DRAWINGS

These and other features, aspects and advantages of the present invention will become better understood with regard to the following description, appended claims, and accompanying figures where:

DETAILED DESCRIPTION

Methods and devices that implement the embodiments of the various features of the invention will now be described with reference to the drawings. The drawings and the associated descriptions are provided to illustrate embodiments of the invention and not to limit the scope of the invention. Reference in the specification to "one embodiment" or "an embodiment" is intended to indicate that a particular feature, structure, or characteristic described in connection with the embodiment is included in at least an embodiment of the invention. The appearances of the phrase "in one embodiment" or "an embodiment" in various places in the specification are not necessarily all referring to the same embodiment.

Throughout the drawings, reference numbers are re-used to indicate correspondence between referenced elements. In addition, the first digit of each reference number indicates the figure where the element first appears.

The following description is provided to enable any person skilled in the art to make and use the invention and sets forth the best modes contemplated by the inventor, but does not limit the variations available.

As used in this disclosure, except where the context requires otherwise, the term "comprise" and variations of the term, such as "comprising", "comprises" and "comprised" are not intended to exclude other additives, components, integers or steps.

In the following description, specific details are given to provide a thorough understanding of the embodiments. However, it will be understood by one of ordinary skill in the art that the embodiments may be practiced without these specific detail. Well-known circuits, structures and techniques may not be shown in detail in order not to obscure the embodiments. For example, circuits may be shown in block diagrams in order not to obscure the embodiments in unnecessary detail.

In the following description, certain terminology is used to describe certain features of one or more embodiments of the invention.

The term "generally" means approximately.

The term "generally cylindrical" means of approximately uniform rounded cross-section.

The present invention overcomes the deficiencies in the prior art by coating the interior glass portion of the dildo with decorations. The decorations can give a wide variety of appearances, but can be seen through the glass portion of the dildo covering, without potentially harming the user. Alternatively, the glass portion of the dildo can be made from decorative glass and no interior decorations would be needed.

Figure 1:
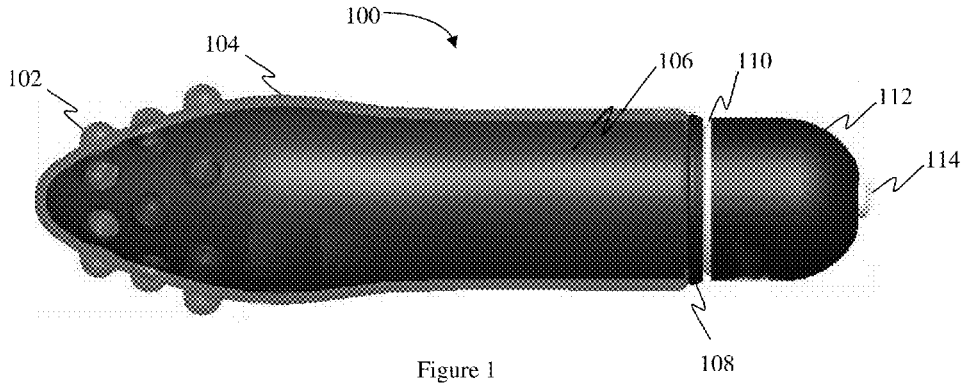
FIG. 1 is a side view of a decorative glass dildo according to the present invention.

Referring now to FIG. 1, there is shown a side view of a decorative glass dildo 100 according to one embodiment of the present invention. As can be seen, the decorative glass plated dildo 100 comprises a solid, high density heat-resistant glass outer portion 104. A coated inner portion 106 that can be coated with decorations or other appealing colors and motifs. Alternatively, the glass outer portion 104 can be made from a variety of frosted, colored or specialty glass obviating the need to decorate the inner portion 106. As can be appreciated, the type and variety of glass used in the outer portion 104 of the present invention is only limited by the availability of the specific glass desired, such as, for example, frosted glass, milky glass, opalescent glass and cracked glass, among others. The glass outer portion 104 can further comprise a plurality of stimulation protuberances 102. As can be seen, the plurality of stimulation protuberances 102 is a spaced array of rounded knobs to provide added stimulation. Additionally, the glass outer portion 104 can comprise a variety of shapes including curves, expanded widths and expanded lengths. The protuberances 102 can also comprise a variety of shapes and styles such as ridges, bumps and indentations. As will be understood by those with skill in the art with reference to this disclosure. As can be seen in this disclosure, the glass outer portion 104 is substantially in the form of an erect penis, and a frosted coating is placed on the inner portion 106.

The decorative glass dildo 100 also comprises a sealing ridge 108 and a waterproof ring gasket 110 to prevent moisture or other liquids from entering into the interior portion 304 of the decorative glass dildo 100. An end portion 112 of the decorative glass dildo 100 mechanically attaches to the interior portion 106 of the glass dildo 100 in a screw like fashion. Optionally, if the glass dildo 100 comprises one or more vibrating elements, then silicon covered switch 114 is provided to actuate the one or more vibrating elements. Although the end portion 112 of the decorative glass dildo 100 is short. In other embodiments it is envisioned that end portion 112 can be elongated to act as a handle, or curved, or as a union between one or more decorative glass dildos 100. Therefore, the exemplar in this instance is not intended to be limiting.

Figure 2:
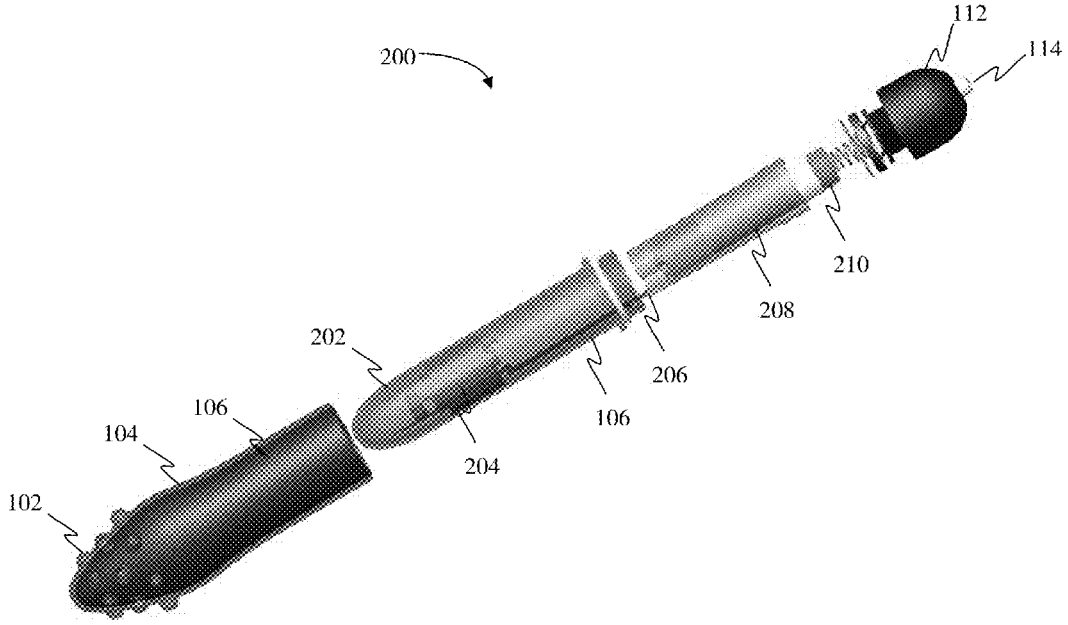
FIG. 2 is an exploded view of the dildo of FIG. 1.

Referring now to FIG. 2, there is shown an exploded view of the dildo of FIG. 1. As can be seen, a generally cylindrical interior housing 202 is provided to contain all mechanical and electrical parts of the decorative glass dildo 100. A vibrating element 204 is provided to add extra stimulation for the user. An electrical conductive strip 206 provides circuit path between batteries contained in battery housing 208, cathode 210 and silicon covered switch 114. This is a typical set up for battery operated devices, as is known in the art.

The generally cylindrical interior housing 202 is affixed to the inner portion 106 of the decorative glass dildo 100 by non-toxic adhesive means. As will be understood by those with skill in the art, the non-toxic adhesive means can be selected from the group comprising silicon glue, contact cement and general purpose glue.

Figure 3:
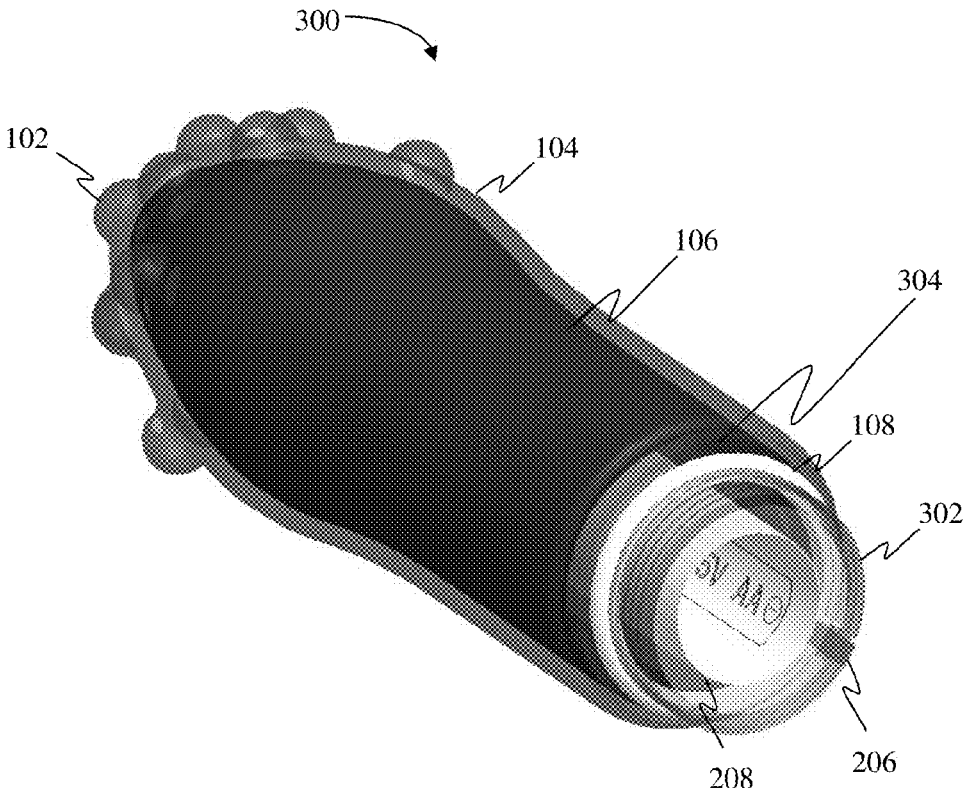
FIG. 3 is a rear view showing the front interior portion of the dildo of FIG. 1.

Referring now to FIG. 3, there is shown a rear view showing the front interior portion 300 of the dildo of FIG. 1. Electrical conductive strip 206 and battery housing 208 can clearly be seen in this view of the present invention. Also, instructions for inserting batteries in the correct manner are imprinted on the interior of battery housing 208 for the user's convenience. Additionally, a screw like attachment means 302 is provided by the interior housing 202 for attaching the outer portion 104 to the end portion 112.

Figure 4:
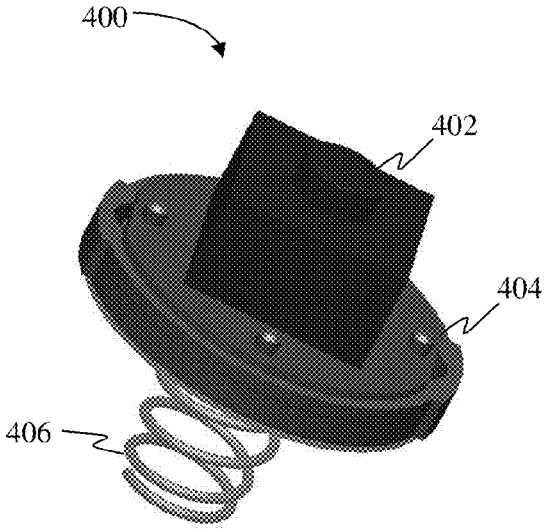
FIG. 4 is a detailed diagram of a switch mechanism useful in the dildo of FIG. 1.

Referring now to FIG. 4, there is shown a detailed diagram of a switch mechanism 400 useful in the dildo of FIG. 1. The switch mechanism 400 comprises an actuator 402, a printed circuit board (PCB) 404 and a cathode tensioning spring 406. The actuator 402 is electrically connected to the PCB 404 and to the cathode tensioning spring 406. Alternatively, the switch mechanism 400 can comprise multiple settings to vary the speed, intensity, bore and stroke of the decorative glass dildo 100.

Figure 5:
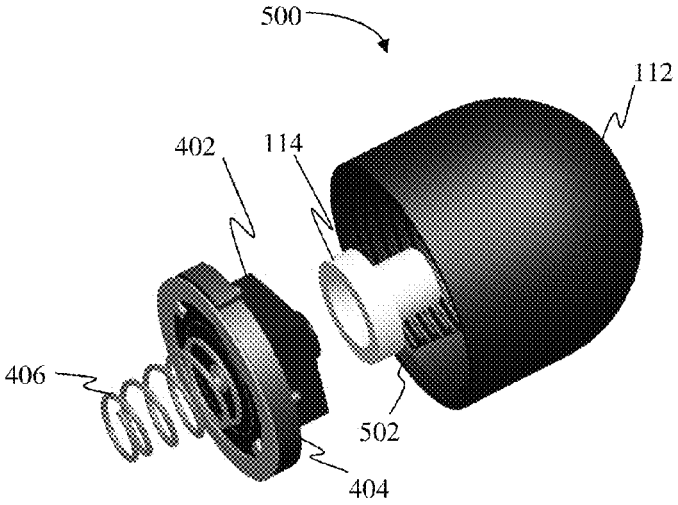
FIG. 5 is a detailed view of the end portion of the dildo of FIG. 1.

Referring now to FIG. 5, there is shown a detailed view of the end portion 500 of the dildo of FIG. 1. As can be seen the end portion 500 comprises the end 112, the silicon covered switch 114, the switch actuator 402, the PCB 404, and the cathode spring 406. Additionally, the interior of the end portion 112 comprises counter screw like ridges 502 for attaching the end portion 112 to the outer glass portion 104 and the adhesively attached interior housing 202. In this embodiment, when the user presses the silicon covered switch 114. The vibrating portion 204 is activated providing extra stimulation for the user.

Figure 6:
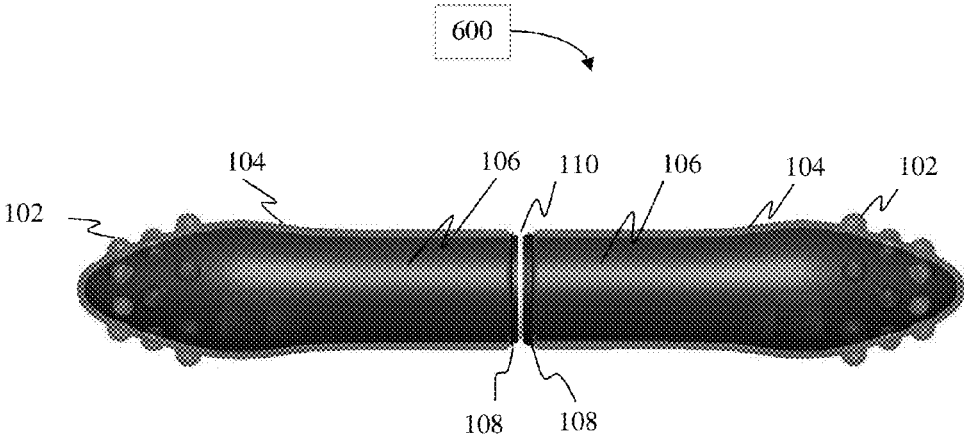
FIG. 6 is a side view of a decorative glass dildo wherein the end portion can be a unison between one or more decorative glass dildos.

Referring now to FIG. 6, there is shown a side view of a decorative glass dildo 100, wherein the end portion 112 can be a unison between one or more decorative glass dildos 100. The decorative glass dildo 100 comprises a sealing ridge 108 and a waterproof ring gasket 110 to prevent moisture from entering into the interior portion 106 of the decorative glass dildo 100.

Although the present invention has been described with a degree of particularity, it is understood that the present disclosure has been made by way of example. As various changes could be made in the above description without departing from the scope of the invention, it is intended that all matter contained in the above description or shown in the accompanying drawings shall be illustrative and not used in a limiting sense.

What is claimed is:

1. A decorative glass dildo comprising:

a) a solid, high density heat-resistant glass outer portion;

b) a coated inner portion;

c) a waterproof ring gasket attached to the inner portion;

d) an electrical conductive strip attached to the inner portion;

e) an end portion mechanically attached to the inner portion of the glass dildo;

f) an actuator;

g) a printed circuit board electrically attached to the actuator; and h) a cathode tensioning spring electrically attached to the printed circuit board.

2. The decorative glass dildo of claim 1, wherein the coated inner portion can comprise decorations.

3. The decorative glass dildo of claim 1, wherein the coated inner portion can comprise appealing colors.

4. The decorative glass dildo of claim 1, wherein the coated inner portion can comprise motifs.

5. The decorative glass dildo of claim 1, wherein the glass outer portion can be made from colored glass.

6. The decorative glass dildo of claim 5, where the colored glass is selected from the group comprising: frosted glass, milky glass, opalescent glass and cracked glass.

7. The decorative glass dildo of claim 1, further comprising a plurality of stimulation protuberances.

8. The decorative glass dildo of claim 7, wherein the plurality of stimulation protuberances is a spaced array of rounded knobs to provide added stimulation.

9. The decorative glass dildo of claim 7, wherein the plurality of stimulation protuberances are selected from the group comprising: bumps, knobs, ridges, indents and serpentine ridges.

10. The decorative glass dildo of claim 1, wherein the glass outer portion is substantially in a form of an erect penis, and the coated inner portion comprises a frosted coating.

11. The decorative glass dildo of claim 1, wherein the decorative glass dildo optionally comprises one or more vibrating elements.

12. The decorative glass dildo of claim 11, further comprising a switch for actuating the one or more vibrating elements.

13. The decorative glass dildo of claim 1, wherein the end portion is elongated to act as a handle.

14. The decorative glass dildo of claim 1, wherein the end portion is curved.

15. The decorative glass dildo of claim 1, wherein the end portion is a union between the dildo and an additional decorative glass dildo.

16. The decorative glass dildo of claim 1, further comprising:

a) a generally cylindrical interior housing to contain all mechanical and electrical parts of the decorative glass dildo;

b) a vibrating element attached to the interior housing;

c) a battery housing slidably attached to the interior housing;

d) a cathode springably attached to the battery housing and a switch; and e) wherein the electrical conductive strip provides a circuit path between batteries contained in the battery housing, the cathode and the switch.

17. The decorative glass dildo of claim 16, wherein the interior housing is affixed to the inner portion of the decorative glass dildo by non-toxic adhesive means.

18. The decorative glass dildo of claim 17, wherein the non-toxic adhesive means is selected from the group comprising: silicon glue, contact cement and general purpose glue.

19. The decorative glass dildo of claim 16, wherein the end portion further comprises screw like ridges for attaching to the battery housing.

20. The decorative glass dildo of claim 16, wherein the switch can comprise multiple settings to vary a speed, intensity, bore and stroke of the decorative glass dildo.

* * * * *